US008157420B2

(12) United States Patent
Song et al.

(10) Patent No.: US 8,157,420 B2
(45) Date of Patent: Apr. 17, 2012

(54) LED LAMP

(75) Inventors: Guang Song, Shenzhen (CN); You-Xue Liu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 117 days.

(21) Appl. No.: 12/610,386

(22) Filed: Nov. 2, 2009

(65) Prior Publication Data

US 2010/0328945 A1 Dec. 30, 2010

(30) Foreign Application Priority Data

Jun. 30, 2009 (CN) ..... 2009 1 0303869

(51) Int. Cl.
*F21V 29/00* (2006.01)

(52) U.S. Cl. ..... 362/294; 362/373; 362/249.03; 362/371; 362/218

(58) Field of Classification Search ..... 362/294, 362/240, 371, 249.01, 249.11
See application file for complete search history.

(56) References Cited

U.S. PATENT DOCUMENTS

| | | | | |
|---|---|---|---|---|
| 2,092,953 | A * | 9/1937 | Carlson | 403/61 |
| 2,605,778 | A * | 8/1952 | Clapper | 135/20.1 |
| 5,727,583 | A * | 3/1998 | Kennedy | 135/20.1 |
| 6,652,117 | B2 * | 11/2003 | Tsai | 362/221 |
| 7,244,058 | B2 * | 7/2007 | DiPenti et al. | 362/547 |
| 7,282,840 | B2 * | 10/2007 | Chih | 313/17 |
| 7,331,689 | B2 * | 2/2008 | Chen | 362/240 |
| 7,674,010 | B2 * | 3/2010 | Griffiths et al. | 362/249.02 |
| 7,758,207 | B1 * | 7/2010 | Zhou et al. | 362/218 |
| D621,090 | S * | 8/2010 | Klu | D26/138 |
| 2006/0146531 | A1 * | 7/2006 | Reo et al. | 362/244 |
| 2007/0047229 | A1 * | 3/2007 | Lee | 362/237 |

* cited by examiner

*Primary Examiner* — Jong-Suk (James) Lee
*Assistant Examiner* — Bryon T Gyllstrom
(74) *Attorney, Agent, or Firm* — Altis Law Group, Inc.

(57) ABSTRACT

An LED (light emitting diode) lamp includes a lamp body, a plurality of fixing assemblies fixed to a top of the lamp body and a plurality of fasteners fixed to the fixing assemblies. The lamp body comprises a housing defining a plurality of runners in a top thereof and a light emitting module mounted in a bottom of the housing and applying an LED module as a light source. The fixing assemblies are placed on the top of the housing. Each fastener has a head located at an underside of a corresponding one of the fixing assemblies and securely received in a corresponding runner. The fixing assemblies are provided for securely fixing the LED lamp in position and in a desired illuminating angle.

1 Claim, 7 Drawing Sheets

LED LAMP

BACKGROUND

1. Technical Field

The disclosure relates to LED (light emitting diode) lamps, and, more particularly, to an LED lamp having a compact structure.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has a nearly infinite lifetime under a specific condition; thus, the LED lamp is intended to be a cost-effective yet high quality replacement for incandescent and fluorescent lamps.

Due to advantages of the LED, the LED lamp is widely used for outdoor and indoor lighting or decorating purposes.

Conventionally, the LED lamp includes a heat sink having a base, an LED module attached to a bottom surface of the base of the heat sink and a housing receiving the LED module therein and engaging the base of the heat sink. Usually, the base of the heat sink is fastened to the housing via screws extending through the base of the heat sink to screw into the housing. Stability of the threaded connection between the heat sink and the housing is poor. The heat sink and the housing are prone to be loosened when the LED lamp suffers vibration. Moreover, it is time-consuming and laborious to screw the screws to the housing through the base of the heat sink in order to combine the heat sink to the housing together.

What is needed, therefore, is an LED lamp having a compact structure with an improved stability and an easy assembly.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
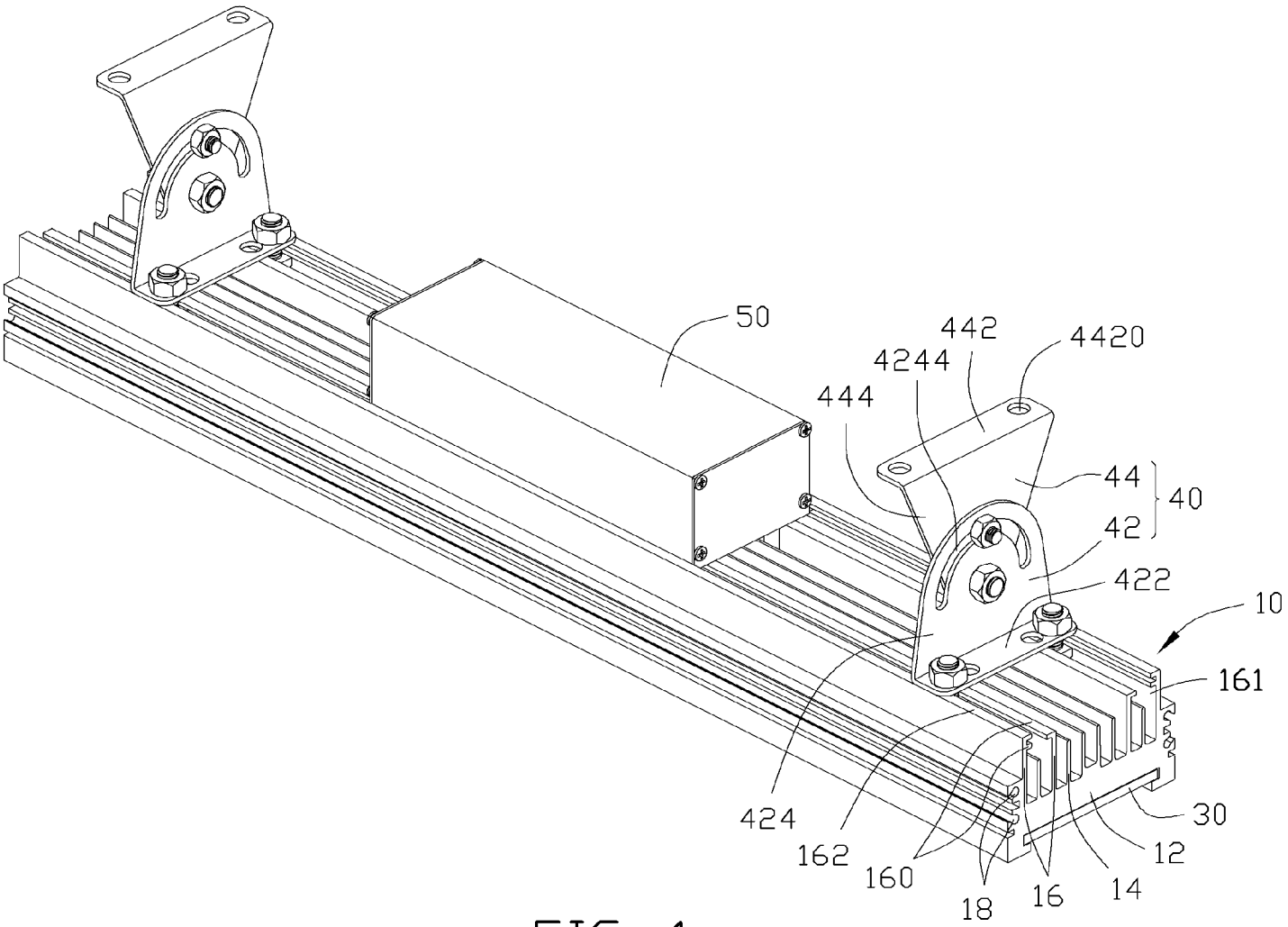
FIG. 1 is an isometric, assembled view of an LED lamp in accordance with a first embodiment of the disclosure.
Figure 2:
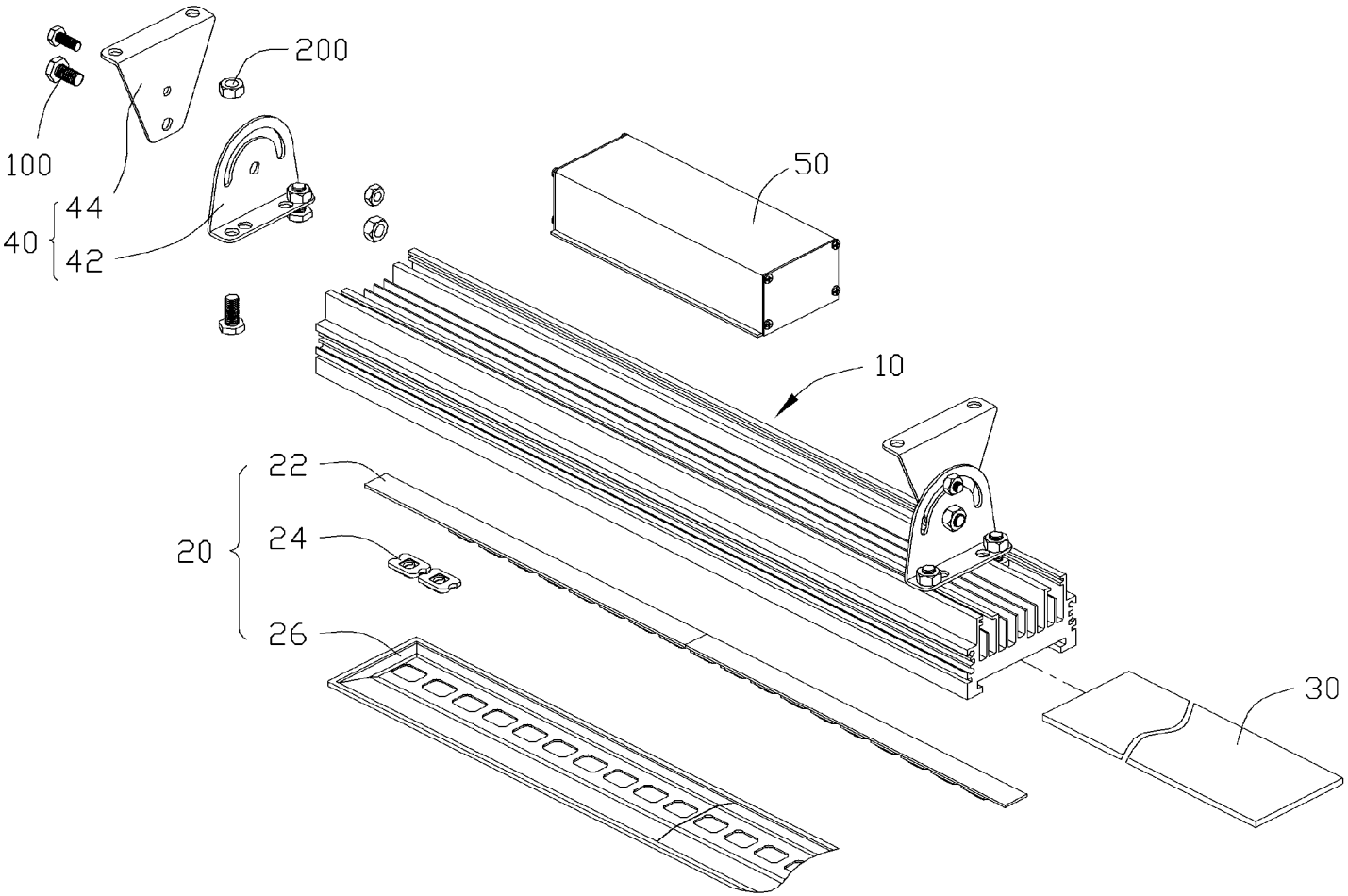
FIG. 2 is an exploded view of the LED lamp of FIG. 1.
Figure 3:
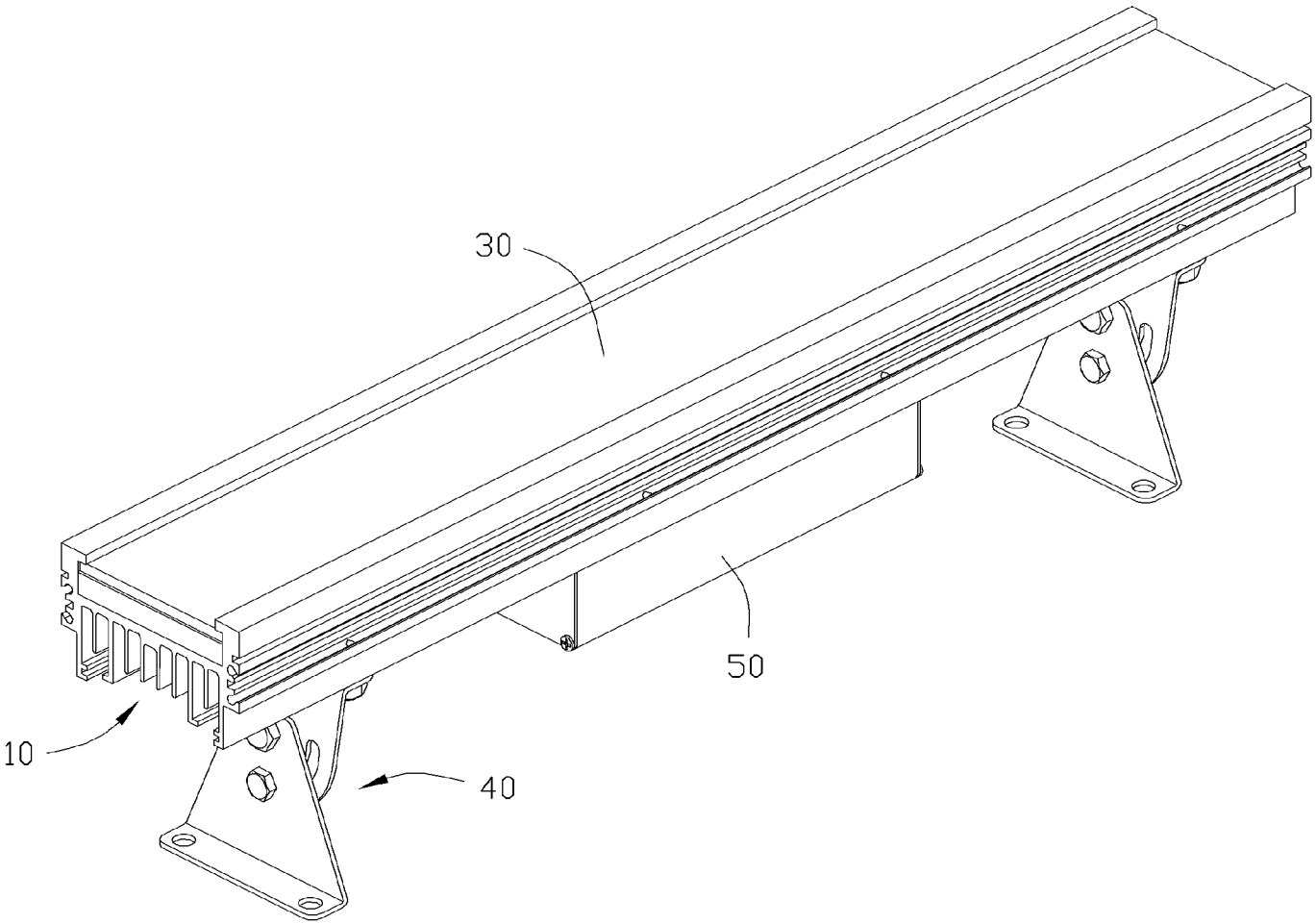
FIG. 3 is an inverted view of the LED lamp of FIG. 1.
Figure 4:
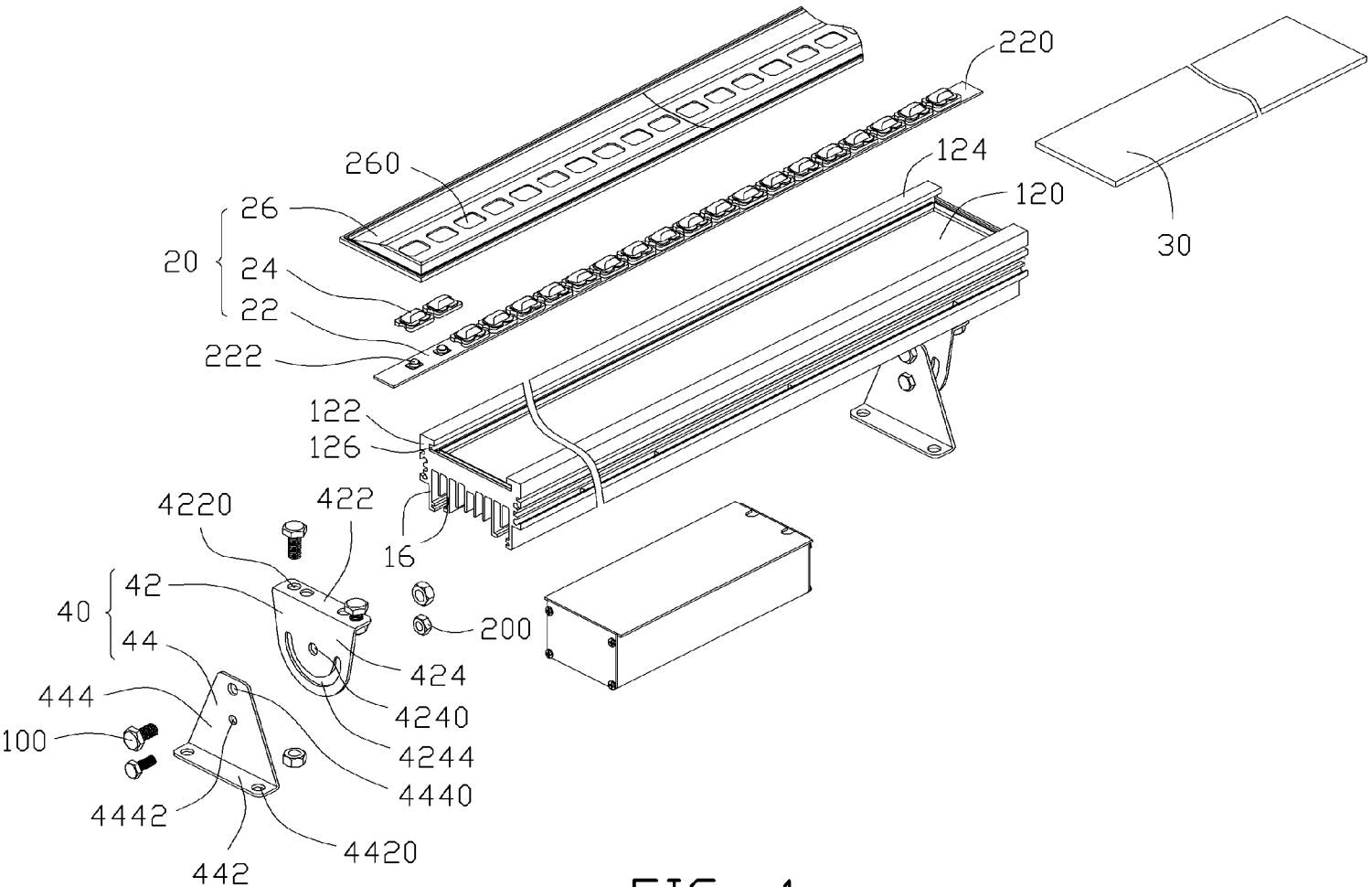
FIG. 4 is an exploded view of the LED lamp of FIG. 3.
Figure 5:
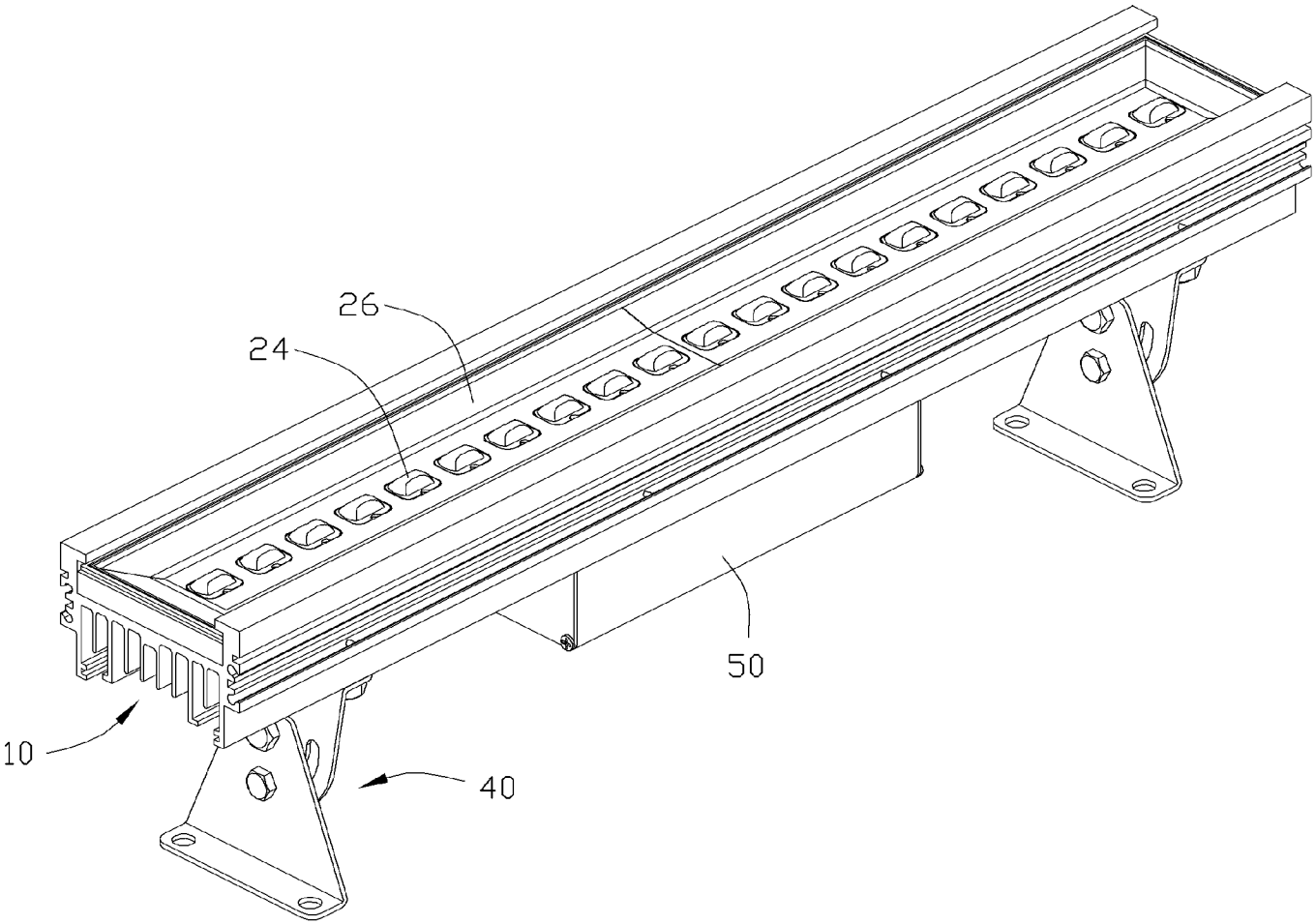
FIG. 5 is a view similar to FIG. 3, with a lens plate of the LED lamp taken away for clarity.

Referring to FIGS. 1-5, an LED lamp in accordance with a first embodiment of the disclosure is illustrated. The LED lamp can be used as a washing wall lamp or a tunnel lamp. The LED lamp comprises a lamp body and two fixing assemblies 40 for securing the LED lamp in place. The lamp body comprises a housing 10, a light emitting module 20 mounted in a bottom of the housing 10 and a lens plate 30 fixed to the bottom of the housing 10 and covering the light emitting module 20.

The housing 10 is integrally formed of a metal with a good heat conductivity such as aluminum, copper or an alloy thereof. In this embodiment, the housing 10 is formed by aluminum extrusion having an aluminum stock extruded along a lengthways direction from a first end to a second end of the housing 10; thus, the housing 10 can be manufactured into different lengths without a requirement of redesigning a new mould. The housing 10 comprises a heat spreader 12, a plurality of fins 14 extending upwardly from a top surface of the heat spreader 12 and two separated fixing parts on a top of the housing 10 and engaging with the fixing assemblies 40. A mounting part 120 is defined in a bottom surface of the heat spreader 12 by recessing inwardly from the bottom surface of the heat spreader 12. The mounting part 120 is rectangular and surrounded by a periphery portion of the heat spreader 12.

Two parallel protruding strips 122 extend downwardly from two opposite lateral edges of the heat spreader 12 and are located at two opposite lateral sides of the mounting part 120. Two holding plates 124 extend inwardly and toward each other respectively from bottoms of the two protruding strips 122. The two holding plates 124 are parallel to and separated from the heat spreader 12. Two elongated receiving slots 126 are defined between the two holding plates 124 and the heat spreader 12 for receiving two opposite lateral portions of the lens plate 30 therein.

Each fixing part includes an elongated runner 161 at the top of the housing 10. Each runner 161 has openings at two opposite ends of the housing 10 for movement of the fixing assemblies 40 into the runner 161 to mount the fixing assemblies 40 to the fixing parts. Each fixing part includes two separated fixing plates 16 extending upwardly and perpendicularly from the top surface of the heat spreader 12. The two fixing plates 16 have different heights, wherein an outer one of the fixing plates 16 located adjacent to the lateral side of the heat spreader 12 is higher than an inner one of the fixing plates 16. Two locking plates 160 extend inwardly and toward each other respectively from a top edge of the inner one of the fixing plates 16 and an inner side of the outer one of the fixing plates 16. The two locking plates 160 of each fixing part level with each other and are located above the fins 14 and parallel to the top surface of the heat spreader 12. Each runner 161 is correspondingly defined among the two fixing plates 16 and the two locking plates 160 of the fixing part and the heat spreader 12. A supporting plate 162 extends inwardly and perpendicularly from a top edge of the outer higher one of the fixing plates 16 of each fixing part and is located above the corresponding locking plate 160. Each supporting plate 162 is separated from and parallel to the corresponding locking plate 160.

The fins 14 are parallel to the fixing plates 16 and the two opposite lateral sides of the heat spreader 12 and have top edges lower than top edges of the fixing plates 16 and the locking plates 160. A plurality of elongated grooves 18 are spaced from each other and are defined in two opposite lateral sides of the housing 10 and parallel to each other. The elongated grooves 18 extend from one end to another opposite end of the lateral sides of the housing 10 along a lengthwise direction and have openings at two opposite ends. Two separated ones of the elongated grooves 18 at each side of the housing 10 respectively have two elongated openings facing laterally and inclined to each other. An upper one of the two elongated grooves 18 faces laterally and downwardly, while a lower one faces laterally and upwardly.

The light emitting module 20 includes an LED module 22 received in the recessed mounting part 120 of the heat spreader 12, a plurality of lens units 24 and a reflector 26. The LED module 22 comprises an elongated printed circuit board 220 and a plurality of LEDs 222 mounted on one side of the printed circuit board 220 and arrayed in a line. The printed circuit board 220 is attached to the bottom surface of the heat spreader 12 in the mounting part 120. The lens units 24 may be made of a transparent material, such as epoxy resin, polymethyl methacrylate (PMMA), and so on. The lens units 24 are fixed to the side of the printed circuit board 220 and respectively encase the LEDs 222. The reflector 26 is rectangular and snugly received in the mounting part 120 of the heat spreader 12 and pressed on the LED module 22. The reflector 26 defines a plurality of cavities 260 in a central part thereof. The cavities 260 are located respectively corresponding to the LEDs 222. Central portions of the lens units 24 encasing the LEDs 222 are extended downwardly through the cavities 260 of the reflector 26 to expose outside. The reflector 26 is concave at the central part to form inclined sidewalls surrounding the lens units 24 and LEDs 222 to reflect light generated by LEDs 222. Periphery portions of the lens units 24 and the printed circuit board 220 are sandwiched between the reflector 26 and the heat spreader 12.

The lens plate 30 is made of a transparent material, such as epoxy resin, polymethyl methacrylate (PMMA). The lens plate 30 has a rectangular configuration. The lens plate 30 is inserted into the two receiving slots 126 beneath the heat spreader 12 from an end of the housing 10. The lens plate 30 is held by two opposite lateral portions thereof being clipped between the two holding plates 124 and the bottom surface of the heat spreader 12 to thus secure the light emitting module 20 in the bottom of the heat spreader 12.

Each of the fixing assemblies 40 comprises a first fixing member 42 mounted on the top of the housing 10 and a second fixing member 44 pivotally connected to the first fixing member 42. The first and second fixing members 42, 44 each are made of metal and have an L-shaped profile. The first fixing member 42 includes a first mounting portion 422 and a first pivotal portion 424 extending perpendicularly from an edge of the first mounting portion 422. The first mounting portion 422 therein defines a plurality of though holes 4220 spaced from each other and arranged in a line. Two fasteners are respectively received in two separated ones of the through holes 4220. Each of the fasteners includes a bolt 100 received in the corresponding through hole 4220 and a nut 200 mounted to the bolt 100 and on the first mounting portion 422. The bolt 100 has a head located at an underside of the first mounting portion 422 and a shaft extending perpendicularly from the head and upwardly into the corresponding through hole 422. The first pivotal portion 424 defines a pivot hole 4240 in a center thereof and a semicircular slot 4244 therein. The semicircular slot 4244 is located above and around the pivot hole 4240 and adjacent to a top edge of the first pivotal portion 424.

The second fixing member 42 includes a second mounting portion 442 and a second pivotal portion 444 extending perpendicularly from an edge of the second mounting portion 442. The second mounting portion 442 defines two spaced through holes 4420 therein and located adjacent to two opposite ends thereof, for the fastener extending therethrough to fix the LED lamp in place. The second pivotal portion 444 defines a pivot hole 4440 in a center of a bottom thereof corresponding to the pivot hole 4240 of the first pivotal portion 424, and further defines a restricting hole 4442 corresponding to the semicircular slot 4244 of the first pivotal portion 424.

In assembly of the fixing assembly 40, one of the bolts 100 is extended through the pivot holes 4440, 4240 of the second, first pivotal portions 444, 424 in sequence to engage with the nut 200, whereby the first and second pivotal portions 424, 444 are sandwiched between the nut 200 and the head of the bolt 100 and the first and second fixing members 42, 44 are rotatably connected together.

In use of the LED lamp, the heads of bolts 100 at bottoms of the fixing assemblies 40 are put into the runners 161 of the housing 10 from the openings at the two opposite ends of the housing 10 and abut against bottom faces of the locking plates 160 of the fixing parts of the housing 10, whilst the first mounting portions 422 of the fixing assemblies 40 are placed on tops of the supporting plates 162 of the fixing parts. The fixing assemblies 40 are movable along the lengthwise direction of housing 10 on the fixing parts to a preferred position. Once moved to the preferred position, the fixing assemblies 40 are locked by further screwing the nuts 200 downwardly toward the housing 10 to make the first mounting portions 422 of the first fixing members 42 to be tightly clamped between the supporting plates 162 and the nuts 200. The first fixing member 42 combined with the housing 10 is rotatable relative to the bolt 100 in the first and second pivot holes 4240, 4440 of the first and second fixing member 42, 44 to adjust an illuminating angle of the LED lamp. Screws (no shown) are used to extend through the through holes 4420 into a supporting structure, for example, a ceiling to securely mount the LED lamp in position. Once the illuminating angle of the LED lamp is decided, the nuts 200 on the bolts 100 in the first and second pivot holes 4240, 4440 are tightened. In addition, the nuts 200 on the bolts 100 in the restricting holes 4442 and the semicircular slots 4244 are tightened. Thus, the LED lamp is securely fixed at the selected illuminating angle.

The LED lamp further comprises a mounting box 50 which is cube-shaped, receives some related electronic components (not shown) therein and fixed on the top of the housing 10 between the two fixing assemblies 40. The electronic components modulate electrical power from an external power source (not shown) and supply the modulated electrical power to the LEDs 222.

Figure 6:
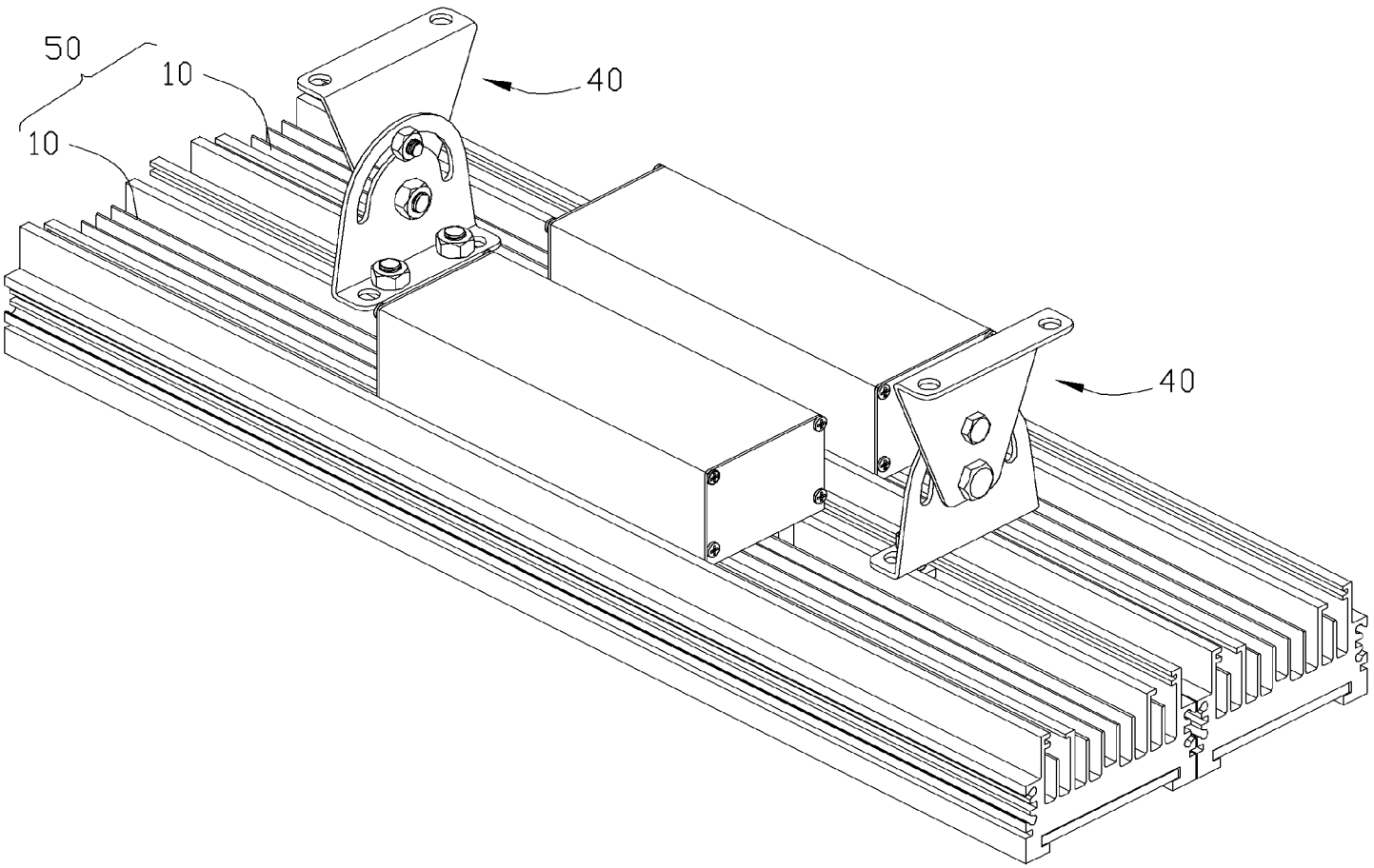
FIG. 6 is an isometric, assembled view of an LED lamp in accordance with a second embodiment of the disclosure.
Figure 7:
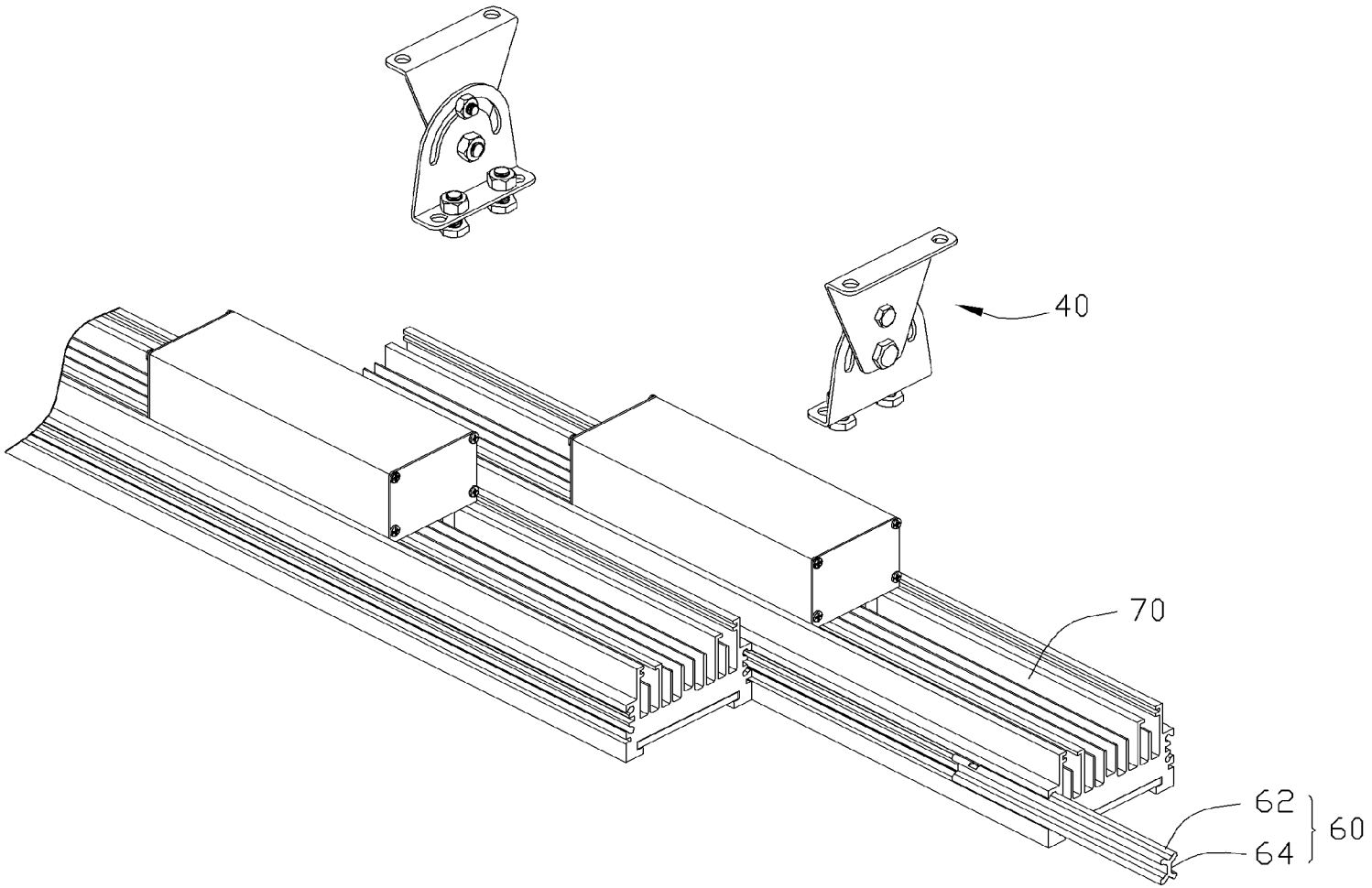
FIG. 7 is a partially exploded view of the LED lamp of FIG. 6.

Referring to FIGS. 6 and 7, an LED lamp in accordance with a second embodiment of the disclosure is illustrated. The LED lamp consists of a plural LED lamp units 70 juxtaposed with each other. Each of the LED lamp unit 70 has the same configuration as the LED lamp of the first embodiment. Two neighboring LED lamp units 70 are connected each other by a connecting member 60. The connecting member 60 is formed of material with a good strength such as aluminum. The connecting member 60 is elongated and has an X-shaped cross section. In this embodiment, the connecting member 60 is shorter than the housing 10. The connecting member 60 comprises a central portion 64 and four inserting portions 62 extending radially from the central portion 64. The inserting portions 62 of the connecting member 60 are respectively inserted into the corresponding elongated grooves 18 in the adjacent lateral sides of the two neighboring LED lamp units 70 to thus couple the two neighboring LED lamp units 70 together. The central portion 64 is located between the corresponding elongated grooves 18.

In the shown embodiments, the housing 10 functions as a combination of a heat sink and a cover in a conventional LED lamp, thereby avoiding complex and time-consuming assembly of the heat sink and the cover via screws. Moreover, the LED lamp of present invention has advantages of a compact structure and excellent stability.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp, comprising:

a lamp body comprising a housing defining a plurality of runners in a top thereof and a light emitting module mounted in a bottom of the housing and comprising an LED module as a light source;

a plurality of fixing assemblies placed on the top of the housing for fixing the LED lamp to a mounting structure at a selected illuminating angle, each of the fixing assemblies being moveable along a lengthwise direction of the housing by moving along the runners; and a plurality of fasteners fixed to the fixing assemblies, each fastener having a bolt and a nut, the bolt having a head located at an underside of a corresponding one of the fixing assemblies and received in a corresponding runner and a shaft extending from the head through the corresponding one of the fixing assemblies, the nut being tightly screwed to the bolt and on a top of the corresponding one of the fixing assemblies to securely mount the corresponding one of the fixing assemblies to the housing;

wherein the housing comprises a heat spreader and a plurality of fins extending upwardly from a top surface of the heat spreader, a mounting part recessing inwardly from a bottom surface of the heat spreader and receiving the light emitting module therein;

wherein a plurality of fixing parts are formed on the spreader, each of the fixing parts comprising two fixing plates having different heights, an outer one of the fixing plates located adjacent to a lateral side of the heat spreader being higher than an inner one of the fixing plates, two locking plates extending inwardly and toward each other respectively from a top edge of the inner one of the fixing plates and an inner side of the outer one of the fixing plates, the locking plates level with each other and located above the fins, each runner being defined in a room surrounded by the locking plates and the fixing plates; and further comprising a supporting plate extending inwardly from a top edge of the outer higher one of the fixing plates and located above the locking plate extending inwardly from the inner side of the outer one of the fixing plates.

* * * * *